US008205966B2

(12) United States Patent
Fukui

(10) Patent No.: US 8,205,966 B2
(45) Date of Patent: Jun. 26, 2012

(54) INKJET PRINT HEAD AND PRINT ELEMENT SUBSTRATE FOR THE SAME

(75) Inventor: Shigeki Fukui, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 414 days.

(21) Appl. No.: 12/636,847

(22) Filed: Dec. 14, 2009

(65) Prior Publication Data

US 2010/0156993 A1 Jun. 24, 2010

(30) Foreign Application Priority Data

Dec. 18, 2008 (JP) ..... 2008-322397

(51) Int. Cl.
*B41J 2/06* (2006.01)

(52) U.S. Cl. ..... 347/58; 29/890.1

(58) Field of Classification Search ..... 347/55–58, 347/40–43, 47; 29/890.1
See application file for complete search history.

(56) References Cited

U.S. PATENT DOCUMENTS 5,297,331 A 3/1994 Childers
7,390,076 B2 * 6/2008 Ma et al. ..... 347/29
7,530,667 B2 * 5/2009 Furukawa et al. ..... 347/45

FOREIGN PATENT DOCUMENTS

JP 6-23997 A 2/1994

* cited by examiner

*Primary Examiner* — Lamson Nguyen
(74) *Attorney, Agent, or Firm* — Fitzpatrick, Cella, Harper & Cella

(57) ABSTRACT

An inkjet print head is provided with a plurality of electrode terminals connected to a plurality of connecting terminals extending from electrical wiring members transmitting drive signals of elements generating energy for ejecting ink, and an insulating portion for insulating the extending portion of the connecting terminal to the connecting portion where the connecting terminal is connected to the electrode terminal from the print element substrate, the connecting portion being sealed by a sealant spreading due to a capillary force between the plurality of the connecting terminals. In order to prevent occurrence of the non-existence region of the sealant due to the blocking of the sealant by the insulating portion, the insulating portion is constructed of a plurality of separated convex portions in contact with the plurality of the connecting terminals respectively to form a groove between the convex portions for allowing the passing of the sealant.

9 Claims, 16 Drawing Sheets

INKJET PRINT HEAD AND PRINT ELEMENT SUBSTRATE FOR THE SAME

BACKGROUND OF THE INVENTION

1. Field of the Invention

The present invention relates to an inkjet print head used in an inkjet printing apparatus for ejecting a liquid such as ink to perform a print operation and a print element substrate for such an inkjet print head. It should be noted that the inkjet print head of the present invention may be applied not only to general printing apparatuses, but also to copying machines, facsimile machines with communication systems, apparatuses such as word processors with print units, or multifunction printers made of a combination with these apparatuses.

2. Description of the Related Art

The construction of the inkjet print head (hereinafter, simply called a print head also) used in the inkjet printing apparatus is disclosed in Japanese Patent Laid-Open No. H06-023997 (1994) or the like.

As the main component of the print head disclosed in Japanese Patent Laid-Open No. H06-023997 (1994), there is a print element substrate equipped with energy generating elements generating energy used for ejecting ink and a plurality of electrode terminals for supplying electrical signals to the energy generating elements. On the other hand, an electrical wiring substrate is connected to the print element substrate. The electrical wiring substrate is provided with an opening surrounding the print element substrate, connecting terminals (lead terminals) projecting into the opening to be connected to the electrode terminals of the print element substrate, connecting terminals receiving electrical signals including drive signals of print elements from an outside, and wiring transmitting electrical signals between these terminals. The print element substrate and the electrical wiring substrate are supported and fixed by a base member.

For example, in a print element substrate in the form of ejecting ink in a direction perpendicular to a main plane of the substrate, energy generating elements are formed on its surface and further, an ejection opening formation member in which ink ejection openings corresponding to the energy generating elements are formed is located thereon. An ink supply opening is provided so as to penetrate through both the front and back surfaces for supplying ink on the print element. The print element substrate is held in a state where the ink supply opening is in communication with an ink flow passage formation member from an ink tank in the back surface side. A peripheral side surfaces of the print element substrate are sealed by a sealant (first sealant), thus preventing leakage of the ink.

The electrical terminal of the print element substrate and the lead terminal of the electrical wiring substrate are electrically connected by a TAB mount technology and the electrical connecting portion is further sealed by a second sealant, thus protecting the connecting portion from corrosion due to ink or from external forces.

First, the first sealant is applied from the side portion of the print element substrate, then the first sealant gradually spreads along the peripheral side surfaces, and thereafter, spreads to the vicinity of the electrical connecting portion by a capillary force. The second sealant is to be applied mainly on the top surface of the electrical connecting portion after the first sealant is applied.

The lead terminal may be in contact with a portion on the print element substrate other than the electrode terminal of the print element substrate caused by external forces or defects of the lead terminal of the electrical wiring substrate.

Therefore, Japanese Patent Laid-Open No. H06-023997 (1994) discloses a technology where of a barrier layer portion is provided in a portion positioned under a lead terminal extending portion to a lead terminal front end connected to the electrode terminal on the print element substrate, thus establishing electrical insulation between the lead terminal extending portion and the print element substrate.

By referring to FIGS. 13 to 15, the technology disclosed in Japanese Patent Laid-Open No. H06-023997 (1994) will be explained. FIG. 13 is a schematic plan view showing the connecting portion between the print element substrate and the electrical wiring member. FIG. 14 and FIG. 15 respectively are schematic cross sections taken along lines XIV-XIV and lines XV-XV in FIG. 13.

In each of the figures, reference symbols H1101 and H1105 denote a print element substrate and electrode terminals located thereon. Reference symbol H1109 denotes an ejection opening formation member in which ejection openings H1107 are formed. The ejection opening formation member H1109 is located on the print element substrate H1101 in a state where the ejection openings H1107 are aligned to the energy generating elements formed on the surface of the print element substrate H1101. Reference symbol H1301 denotes an electrical wiring substrate having an opening H1303 through which the print element substrate H1101 is exposed, Lead terminals H1304 are extend inside the opening H1303 and the front ends thereof are connected to the electrode terminals 1105. An integral barrier layer (insulating portion) 110 is provided in a portion positioned under the extensions of the lead terminals H1304 on the print element substrate 1101, where the barrier layer extends along an arrangement direction of the lead terminals H1304.

However, the construction disclosed in Japanese Patent Laid-Open No. H06-023997 (1994) has the problem as described below.

FIG. 16 will be used to explain this problem. The peripheral side surfaces of the print element substrate H1101 are sealed by the first sealant H1307, but at this time, the first sealant H1307 spreads to the connecting portion between the electrode terminal H1105 and the lead terminal H1304 for the sealing. However, in a case where the integral insulating portion 110 is provided along the arrangement direction of the lead terminals H1304 as Japanese Patent Laid-Open No. H06-023997 (1994), the first sealant H1307 which should spread to the vicinity of the electrical connecting portion by a capillary force may be blocked by the insulating portion 110. As a result, the first sealant is not sufficiently filled in a part of the electrical connecting portion, and therefore, a region where air bubbles exist or where the first sealant H1307 is not sufficiently filled may be left between the lead terminal H1304 and the print element substrate H1101 or between the lead terminals H1304.

When the second sealant is applied in a state where the region exists, in the heating process for sealant hardening as the process after the applying, the air may possibly inflate to be communicated with ambient air. Then, inflow of ink may occur, possibly deteriorating electrical reliability of the print head. In addition, a crack may be generated in the sealant by an external force applied at print operating after mounting the print head to the printing apparatus, possibly causing the deterioration of electrical reliability, similarly.

SUMMARY OF THE INVENTION

Accordingly, an object of the present invention is to improve electrical reliability of a print head by preventing occurrence of a region where an air bubble exists or where a sealing member (first sealant) is not filled.

In an aspect of the present invention, there is provided a method of manufacturing an inkjet print head comprising the steps of:

preparing a print element substrate having a plane provided with elements generating energy for ejecting ink, a plurality of electrode terminals connected electrically to the elements and arranged in an array, and a plurality of insulating members arranged in an array along the plurality of the electrode terminals, the plurality of insulating members being provided on a portion more closer to an edge of the plane than the plurality of electrode terminals;

locating a plurality of electrical wiring members electrically connecting an external electrical wiring substrate to the electrode terminals in such a manner as to be in contact with the electrode terminals, and to be supported by the plurality of insulating members; and applying a sealing member on a periphery of the print element substrate in such a manner that the sealing member reaches between the neighboring electrical wiring members and providing the sealing member between the neighboring electrode terminals using a capillary force between the neighboring electrical wiring members.

In another aspect of the present invention, there is provided an inkjet print head comprising:

a print element substrate having a plane provided with elements generating energy for ejecting ink, a plurality of electrode terminals connected electrically to the elements and arranged in an array, and a plurality of insulating members arranged in an array along the plurality of the electrode terminals, the plurality of insulating members being provided on a portion more closer to an edge of the plane than the plurality of electrode terminals;

a plurality of electrical wiring members in contact with the electrode terminals to electrically connect an external electrical wiring substrate to the electrode terminals, and supported by the plurality of insulating members; and a sealing member provided between the neighboring electrical wiring members, wherein the insulating members are provided to correspond respectively to the electrode terminals.

According to the present invention, by providing the groove in the insulating portion on the print element substrate, the sealing member (first sealant) which is first applied to the periphery of the print element substrate and then spreads out due to the capillary force between the plurality of the lead terminals to seal the connecting portion is difficult to be blocked by the insulating portion. That is, the sealing member passes through the groove to cause smooth transfer thereof, so that the non-existence region of the sealing member is difficult to remain.

Therefore, any communication with ambient air does not occur in heating of sealant hardening after another sealing member (second sealant) is applied, thereby reducing the possibility of deterioration of electrical reliability of the print head due to conduction by ink. Further, there can be prevented also occurrence of the problem that a crack is produced in the sealant by an external force applied at print operating after mounting the print head to the printing apparatus, breaking insulated condition. As a result, the reliability of the print head can be improved.

Further features of the present invention will become apparent from the following description of exemplary embodiments (with reference to the attached drawings).

DESCRIPTION OF THE EMBODIMENTS

Hereinafter, the present invention will be explained in detail with reference to the drawings.

A print head according to an embodiment of the present invention is integral with an ink tank in such a manner as to be inseparable therefrom. For example, the print head may be provided with ink containing portions each filled with color ink (cyan ink, magenta ink and yellow ink) and ejection portions each ejecting the color ink supplied from each ink containing portion. Such a print head is fixed and supported on a carriage of the printing apparatus by positioning means and electrical contacts, for example, and may be configured in the form of a cartridge removable to the carriage. When the filled ink does not exist due to its consumption, the print head may be replaced with a new one.

(1) Construction of Print Head

By referring to FIG. 1, FIG. 2A and FIG. 2B, a basic construction of a print head H1001 used in an embodiment will be explained hereinafter.

Figure 1:
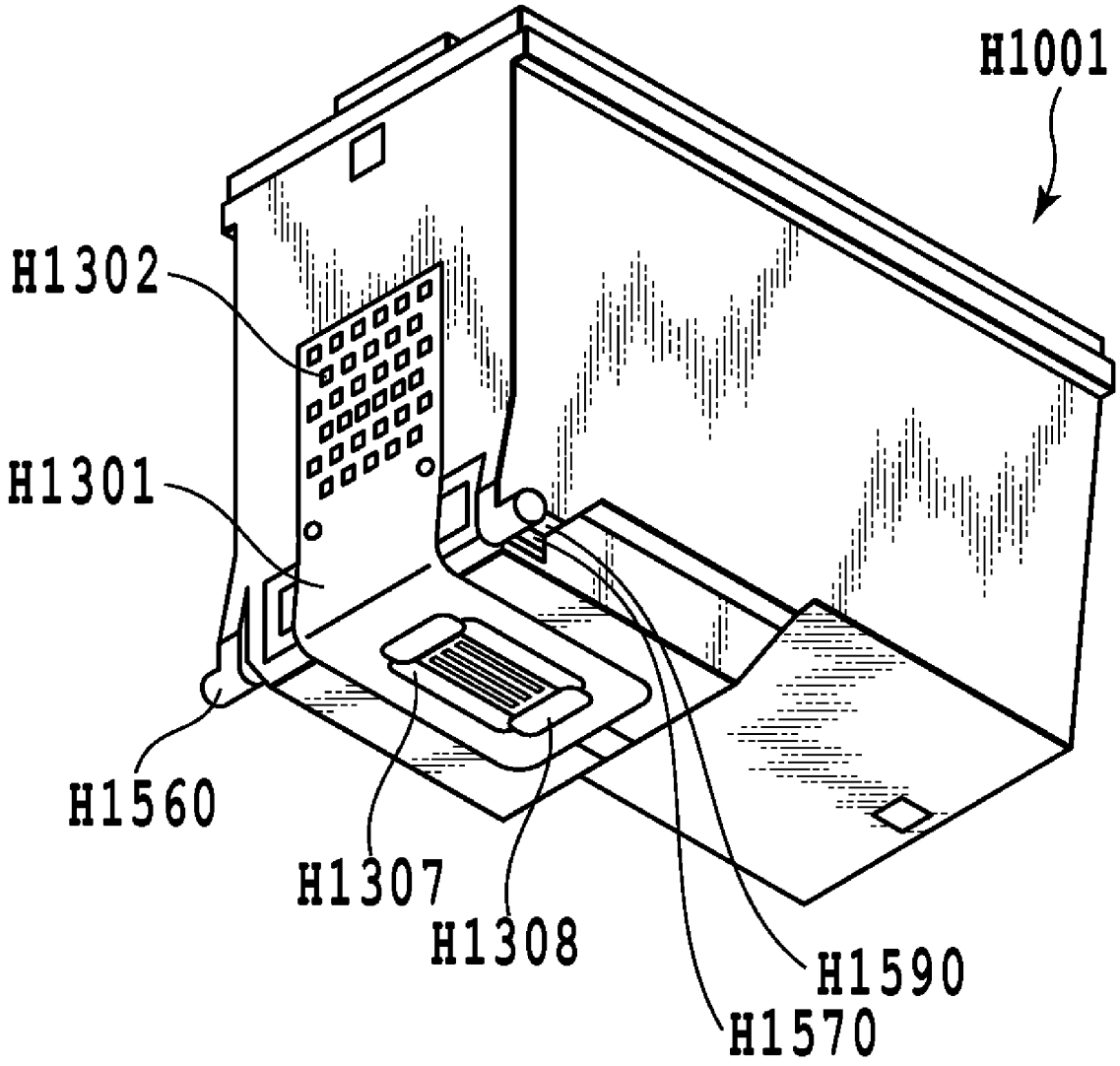
FIG. 1 is a perspective view showing the construction example of the print head to which the present invention applicable.
Figure 2A:
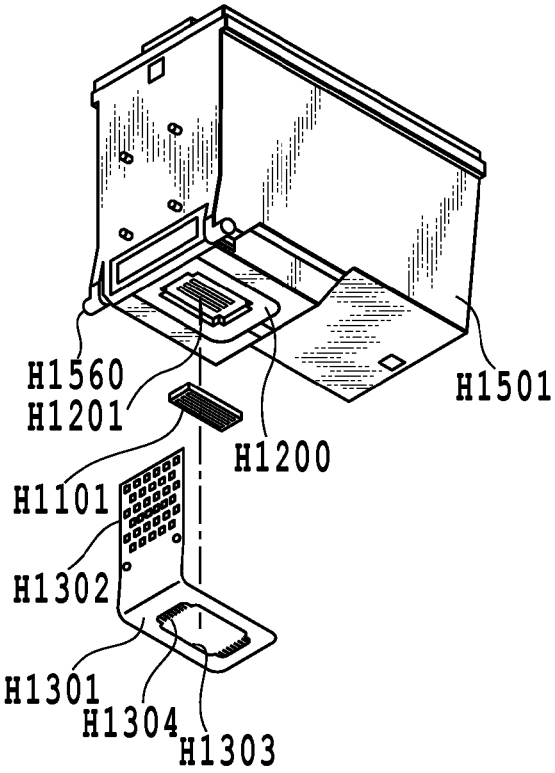
FIGS. 2A and 2B are exploded perspective views of the print head shown in FIG. 1.
Figure 2B:
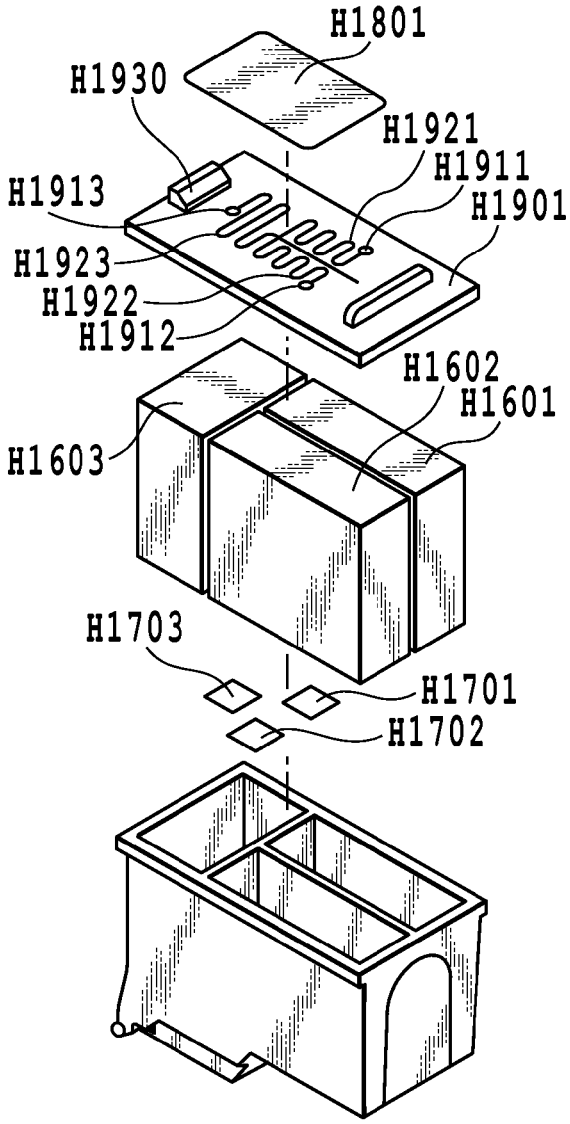

FIG. 1 is a perspective view showing the construction example of the print head H1001, and FIG. 211 and FIG. 2B are exploded perspective views thereof.

The print head H1001 is provided with mount guides H1560 for guiding the print head H1001 to a mount position on the carriage of the inkjet printing apparatus body and projections H1570 and H1590 for positioning the print head H1001 on a predetermined mount position of the carriage. By positioning the print head H1001 on the carriage 102 through these projections, it is possible to make electrical contact between external signal connecting terminals H1302 on a tape-shaped electrical wiring substrate (hereinafter, called an electrical wiring tape) H1301 and contact pins of the electrical connecting portion provided in the carriage.

The print head H1001 is provided with a print element substrate H1101, the electrical wiring tape H1301, an ink containing and supplying member H1501 which also serves as a supporting member for the electrical wiring tape H1301, filters H1701 to H1703, ink absorbers H1601 to H1603, a lid member 1901 and a seal member H1801. Hereinafter, main components among them will be in detail explained.

Print Element Substrate

Figure 3:
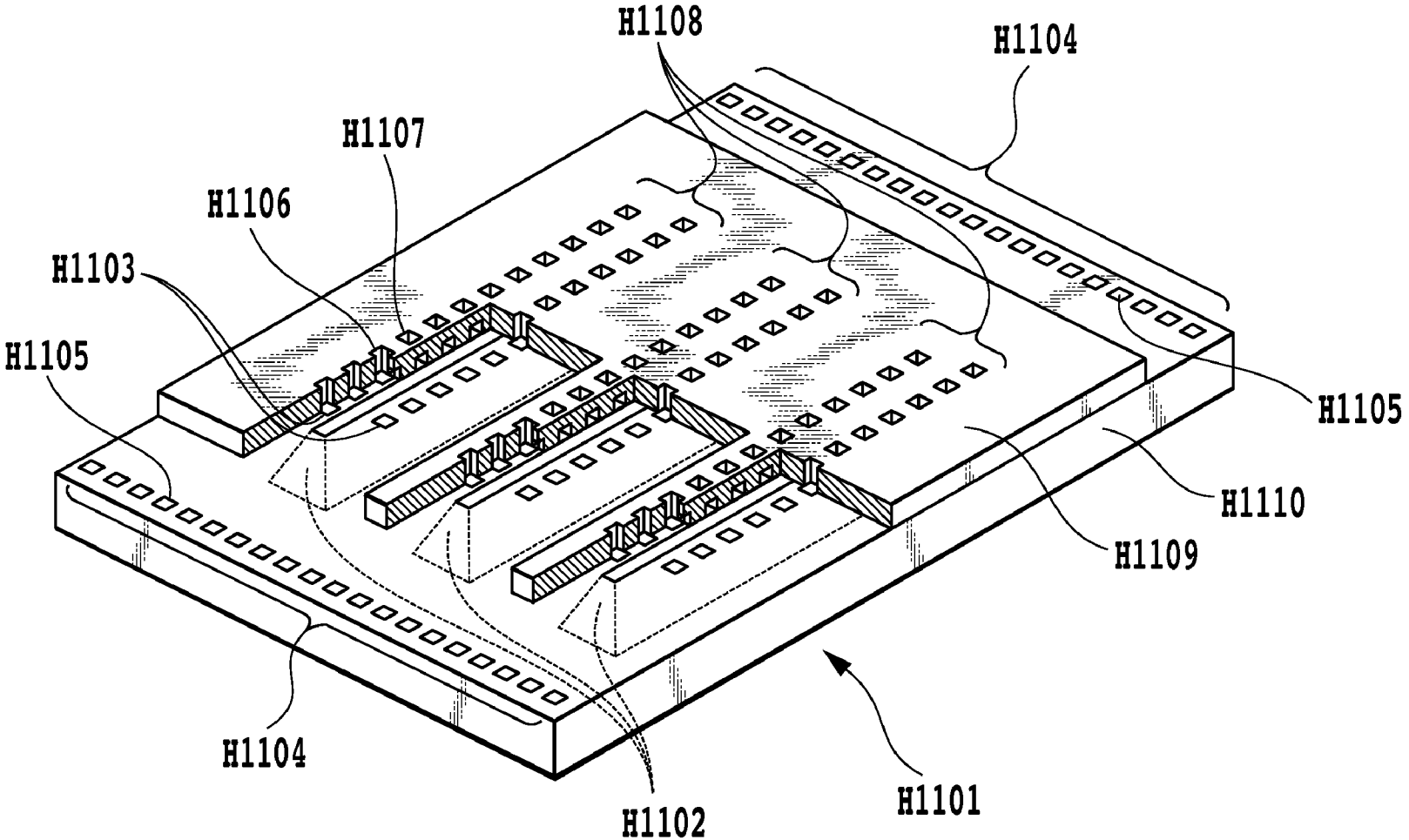
FIG. 3 is a partial cutaway view in perspective for explaining the basic construction of the print element substrate to which the present invention applicable.

FIG. 3 is a partial cutaway view in perspective of the basic construction of the print element substrate H1101 for explaining it. The print element substrate in the present embodiment uses electrothermal transducer elements generating thermal energy for producing film boiling in ink in response to an electrical signal. The electrothermal transducer elements and the ink ejection openings are located to be opposed with each other, thus ejecting the ink in a direction vertical to a main plane of the substrate.

As shown In FIG. 3, the print element substrate H1101 comprises a Si base having a thickness of 0.5 mm to 1 mm and having three ink supply openings H1102 for each color ink of cyan, magenta and yellow to be in parallel with each other, the ink supply opening being a slot-like through-hole. An array of electrothermal transducer elements H1103 is located in both sides of the ink supply opening H1102 to place it therebetween. An electrothermal transducer elements H1103 generates thermal energy for producing film boiling in the ink in response to an electrical signal. The electrothermal transducer elements of the respective arrays are located to be shifted with each other by a half of an arrangement pitch in an arrangement direction thereof. An ejection opening formation member H1109 made of a resin material in which liquid path walls H1106 and ejection openings H1107 are formed by a photo lithography technology is bonded on the print element substrate H1101 to align each position of the electrothermal transducer elements with each position of the ejection openings, thus constructing an ejection portion H1108 of each color.

On the Si substrate H1110, formed are electrical wiring of Al or the like for supplying power to the electrothermal transducer elements H1103, a logic circuit for driving the electrothermal transducer elements in accordance with print data, and electrode portions H1104 for electrically connecting these elements to an outside. Further, electrode terminals H1105 are formed in the electrode portion in the form of bumps by plating Au or the like. The electrothermal transducer elements H1103 and the others may be formed using the existing film forming technology.

The print element substrate N1101 according to the first embodiment of the present invention is provided with a characteristic construction to be described later in addition to the above-mentioned basic construction.

Electrical Wiring Tape

The electrical wiring tape H1301 has a wiring pattern to be a plurality of electrical wiring members made of copper foil formed on a base material of polyimide, thereby forming electrical signal paths for applying electrical signals to eject ink to the print element substrate H1101. The electrical wiring tape H1301 has an opening H1303 formed therein for incorporating the print element substrate H1101. Lead terminals H1304 as connecting terminals to be connected to the electrode portions H1104 of the print element substrate H1101 are formed to be extended from edges of the opening H1303. The external signal connecting terminals H1302 for receiving electrical signals from the apparatus body are formed on the electrical wiring tape H1301. The lead terminal H1304 and the external signal connecting terminal H1302 are connected with a conductive wiring pattern including continuous copper foils or the like. Here, the electrical wiring tape H1301 is formed using a TAB tape and the lead terminal H1304 is exposed.

The electrical connection between the electrical wiring tape H1301 and the print element substrate H1101 is made as follows, for example. That is, the electrode terminals H1105 formed in the electrode portion H1104 in the print element substrate H1101 and the corresponding lead terminals H1304 of the electrical wiring tape H1301 are electrically bonded by an ultrasonic thermal bonding method.

Ink Containing and Supplying Member

The ink containing and supplying member H1501 which also serves as the support member for supporting the print element substrate H1101 constituting the ejection portions and the electrical wiring tape H1301 incorporating the electrical wiring members is formed by molding a resin. It is preferable to use a resin material mixed with glass fillers in some ratio for improving structural rigidity as the resin material thereof.

The ink containing and supplying member H1501 is provided with an ink tank function and an ink supply function. That is, as shown in FIG. 2B, the ink containing and supplying member H1501 realizes the ink tank function by having spaces therein for independently accommodating ink absorbers H1601, H1602, and H1603 generating negative pressures for holding ink of cyan, magenta and yellow. The ink containing and supplying member H1501 realizes the ink supply function by incorporating therein a flow path member H1200 having independent liquid paths formed therein for introducing each ink into the respective ink supply openings H1102 in the print element substrate H1101.

The flow path member H1200 has a recess for receiving the print element substrate H1101 therein. The ink supply openings H1102 are formed in the recess for supplying each color ink of cyan, magenta and yellow to the print element substrate H1101. The print element substrate H1101 is adhered and fixed to the ink containing and supplying member H1501 to be accurately positioned thereto in such a manner that each ink supply opening H1102 in the print element substrate H1101 is in communication with each ink supply opening H1201 in the ink containing and supplying member H1501.

In addition, a part of the back surface in the electrical wiring tape H1301 is adhered and fixed on a plane of the recess periphery of the flow path member H1200. An electrical connecting portion between the print element substrate H1101 and the electrical wiring tape H1301 is sealed by a first sealant H1307 and a second sealant (another sealing member) H1308, thereby protecting the electrical connecting portion from corrosion due to ink or an external impact. The first sealant H1307 seals mainly a back surface side of the connecting portion between the lead terminal H1304 of the electrical wiring tape H1301 and the electrode terminal H1105 of the print element substrate H1101 and an outer peripheral portion of the print element substrate H1101, while the second sealant H1308 seals a front surface side of the connecting portion.

On the other hand, a region of the electrical wiring tape H1301 where the external signal connecting terminals H1302 are arranged is bent along a body side surface of the ink containing and supplying member H1501 orthogonal to a plane having the ink supply opening H1201. By inserting pins projecting from the body side surface through several holes formed in the periphery of the region, and by performing heat caulking, the electrical wiring tape H1301 is fixed to the ink containing and supplying member H1501. Alternatively, such fixation may be carried out by adhering the back surface side of the region to the body side surface.

(2) Characteristic Construction of Print Element Substrate

Figure 4:
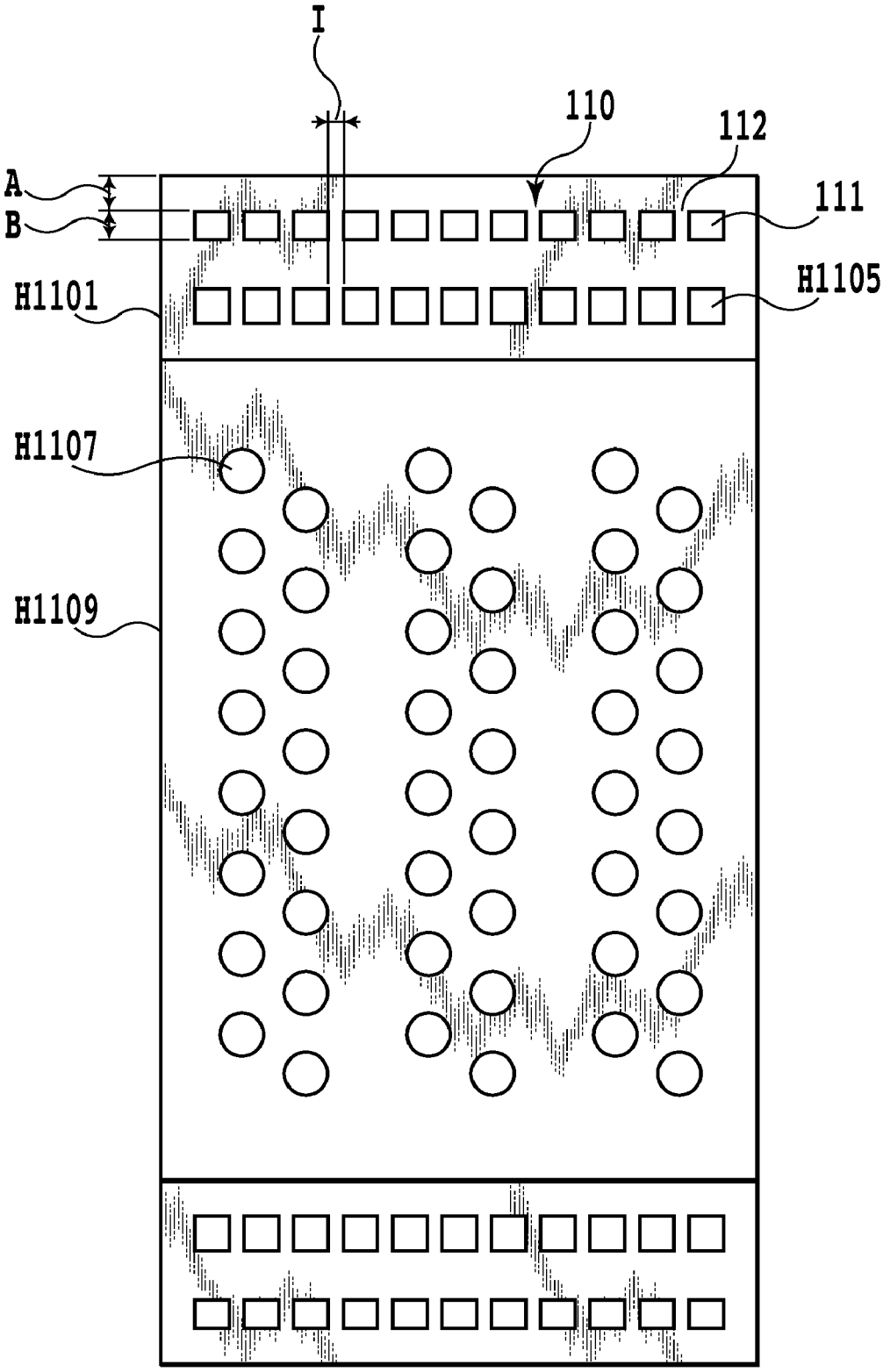
FIG. 4 is a schematic plan view showing a print element substrate according to a first embodiment of the present invention.
Figure 5:
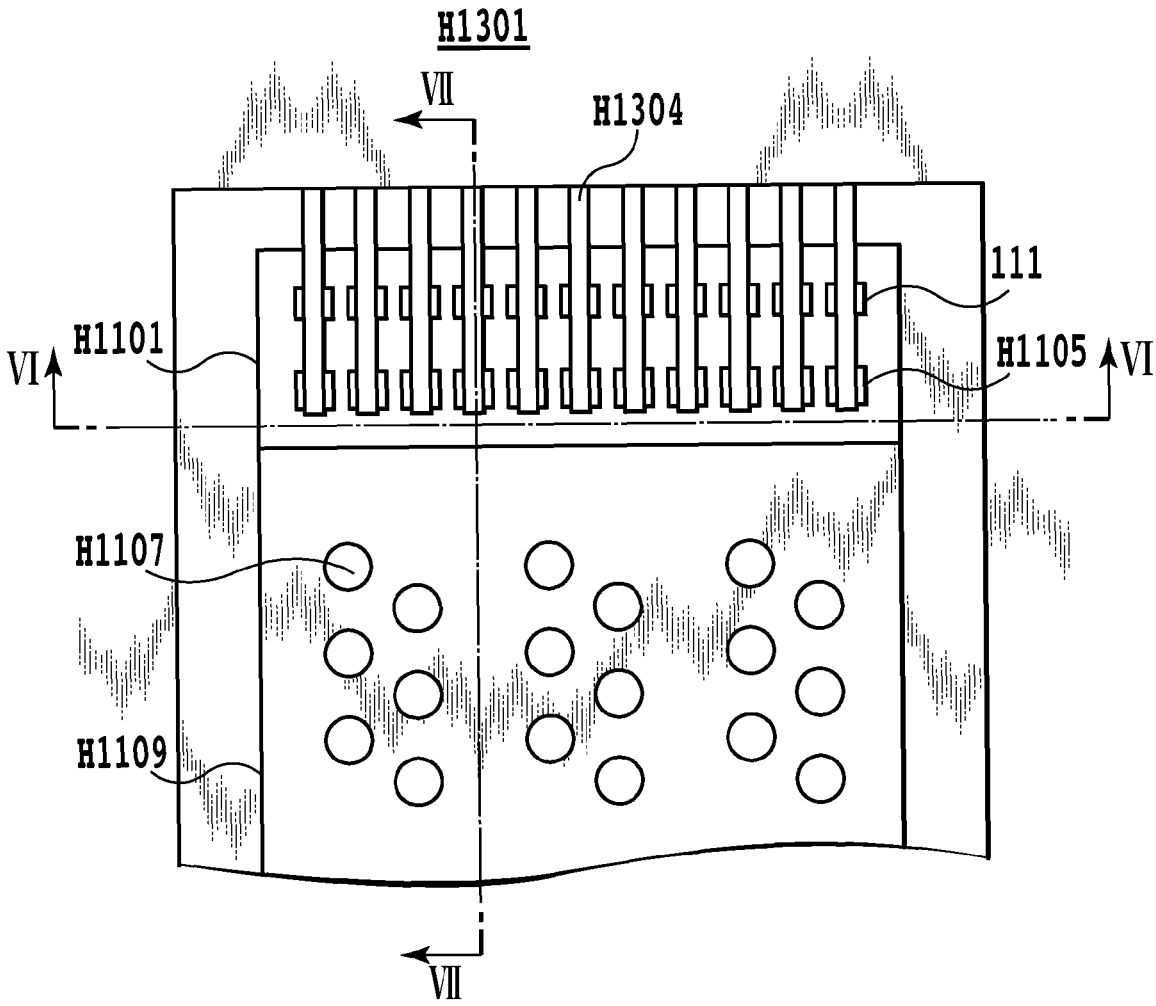
FIG. 5 is a schematic plan view showing a connecting portion between the print element substrate shown in FIG. 4 and an electrical wiring tape.
Figure 6:
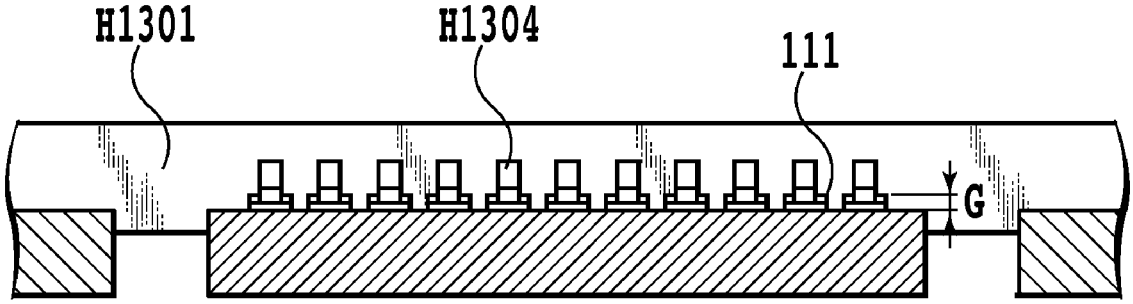
FIG. 6 is a schematic cross section taken along line VI-VI in FIG. 5.
Figure 7:
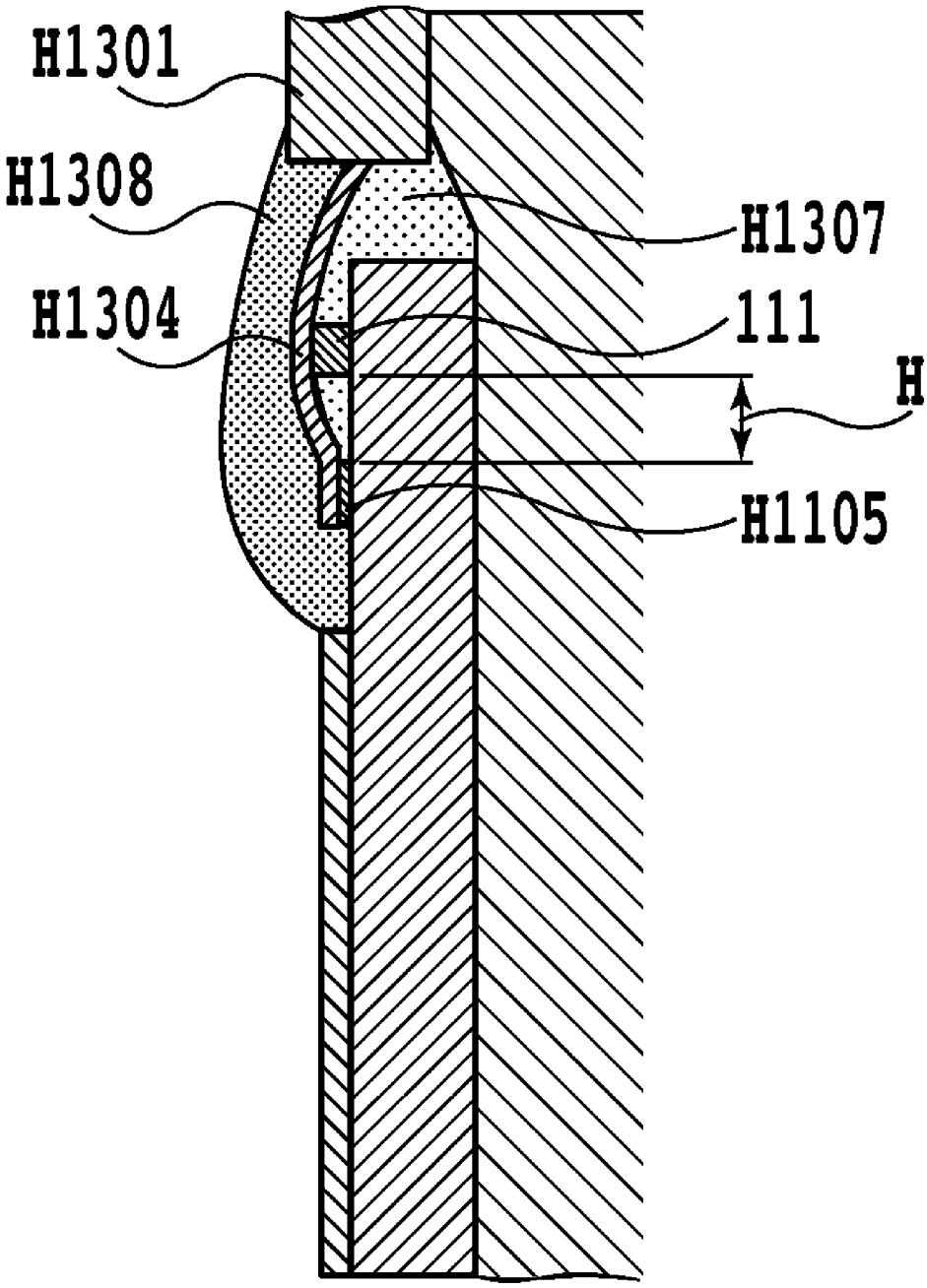
FIG. 7 is a schematic cross section taken along line VII-VII in FIG. 5.

By referring to FIGS. 4 to 7, the characteristic construction of the present embodiment will be explained in detail. FIG. 4 is a schematic plan view showing the print element substrate according to the present embodiment. FIG. 5 is a schematic plan view showing the connecting portion between the print element substrate and the electrical wiring tape. FIGS. 6 and 7 are schematic cross sections taken along lines VI-VI and lines VII-VII in FIG. 5, respectively. FIG. 7 shows an applying state of the first sealant H1307 and the second sealant H1308.

The insulating portion 110 of the present embodiment is not formed as an integral barrier layer extending in the arrangement direction of the lead terminals H1304, but is formed in such a manner that a plurality of convex portions 111 are arranged along this direction. In consequence, a groove 112 parallel to the extending direction of the lead terminal is formed between the neighboring convex portions 111. The convex portion 111 is positioned on the print element substrate H1101 under the extending portion of the lead terminal H1304 to be in contact with the lead terminal H1304 and therefore, serves as an insulating portion establishing electrical insulation between the lead terminal extending portion and the print element substrate. The insulation portion of the present embodiment having the convex portions 111 and the grooves 112 may be formed by the photolithography technology in the same way as the structural body (that is, ejection opening formation member H1109) made of a resin material forming the ejection openings and liquid passages leading thereto for respective electrothermal transducer elements H1103.

The convex portion 111 in the present embodiment is formed in substantially a rectangular parallelepiped shape, and a dimension thereof maybe defined as needed in consideration of an arrangement position thereof on the print element substrate H1101 and a dimension, flexible characteristics and the like of the lead terminal H1304.

For example, in a case where a length A (FIG. 4) from the insulating portion 110 to an edge of the print element substrate H1101 in a direction (lead-terminal extending direction) orthogonal to the arrangement direction is not appropriate, insulated condition may not be ensured due to contact between the lead terminal H1304 and the print element substrate H1101. That is, in a case where the length A is excessively small (the convex portion 111 is shifted to the print element substrate edge side), the lead terminal extending portion from the convex portion 111 toward the electrode terminal H1105 possibly contacts the print element substrate H1101. On the other hand, in a case where the length A is excessively large (the convex portion 111 is shifted to the electrode terminal side), the lead terminal extending portion from the insulating portion 110 toward the electrical wiring tape H1301 possibly contacts the edge of the print element substrate H1101. For avoiding these problems, the length A is set to the order of 40 μm in the present embodiment.

When a width B (FIG. 4) of the convex portion 111 in a direction (lead-terminal extending direction) intersected (orthogonal) to the arrangement direction is narrow, by stress generated by connection between the electrode terminal H1105 and the lead terminal H1304, the convex portion 111 is possibly deformed or damaged by falling down laterally. For avoiding this problem, the width B is set to the order of 30 μm in the present embodiment.

Further, also in a case where a thickness G of the convex portion 111 (FIG. 6) is not appropriate, the following problem occurs. That is, in a case where the thickness G is excessively small, the lead terminal extending portion from the convex portion 111 toward the electrical wiring tape H1301 possibly contacts the edge of the print element substrate H1101. On the other hand, in a case where the thickness G is excessively large, the deformation of the lead terminal H1304 becomes large, increasing the stress applied on the connecting portion of the lead terminal H1304 to the electrode terminal H1105 and the convex portion 111. Then, the connecting portion of the lead terminal H1304 possibly peels off, or cracks or damages are possibly generated in the convex portion 111. In consideration of these matters, the thickness G is set to the order of 25 μm in the present embodiment.

In addition, in a case where a distance H (FIG. 7) from the convex portion 111 to an end (end at the side of the convex portion 111) of the connecting portion of the lead terminal H1304 to the electrode terminal H1105 is short, the problem similar to a case where the thickness G of the convex portion 111 is excessively large may possibly occur. Therefore, In consideration of this problem, the distance H is set to the order of 60 μm in the present embodiment.

Further, in the present embodiment, each electrode terminal H1105 and each convex portion 111 are aligned in the extending direction of the lead terminal H1304. In other words, the groove 112 is located in each position corresponding to a clearance between the neighboring lead terminals H1304. Hero, if a width of the groove 112 is excessively small, it may interrupt smooth spread of the first sealant H1307 (the blocking similar to the conventional possibly occurs). On the other hand, if the width of the groove 112 is excessively large, that is, if the width of the convex portion 111 is extremely narrow in the arrangement direction, the lead terminal H1304 possibly falls down into the groove 112. Therefore, in consideration of this problem, the distance between the neighboring electrode terminals H1105 is set to 40 μm in the present embodiment, while a width I (FIG. 4) of the groove 112 is also set to a distance equivalent thereto. However, for effectively preventing the falling-down of the lead terminal H1304, it is preferable that the width I of the groove 112 is set slightly smaller than the distance between the neighboring electrode terminals H1105.

As described above, the electrical connecting portion between the print element substrate H1101 and the electrical wiring tape H1301 is sealed by the first sealant H1307 and the second sealant H1308, thus achieving the function of protecting the electrical connecting portion from corrosion due to ink or from an external impact. As shown in FIG. 7, the first sealant H1307 seals mainly a peripheral portion of the print element substrate H1101 and also seals generally the connecting portion between the lead terminal H1304 of the electrical wiring tape H1301 and the electrode portion H1104 of the print element substrate H1101 from the backside of the lead terminal. On the other hand, the second sealant H1308 seals the connecting portion from the front side of the lead terminal generally.

Figure 8:
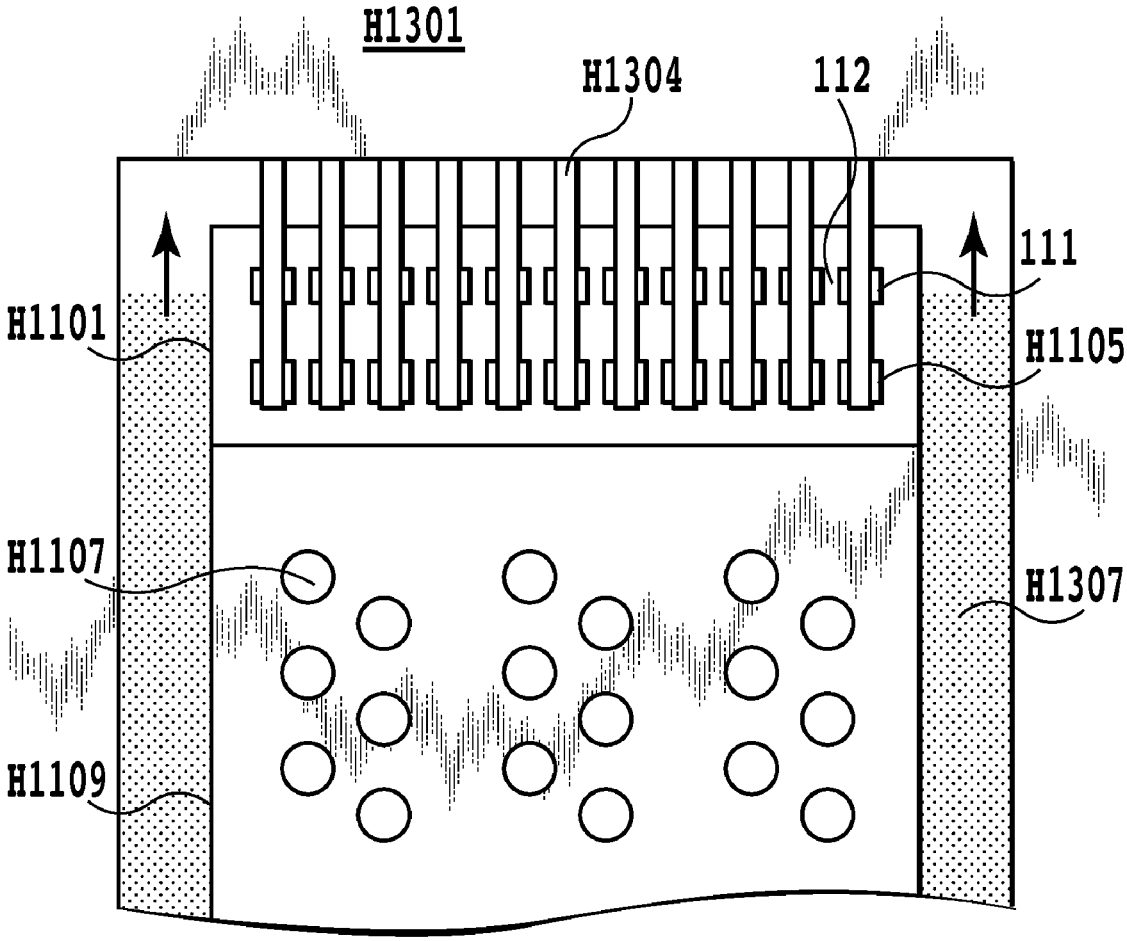
FIG. 8 is an explanatory diagram explaining a state where the first sealant applied to the construction of the first embodiment spreads out.
Figure 9:
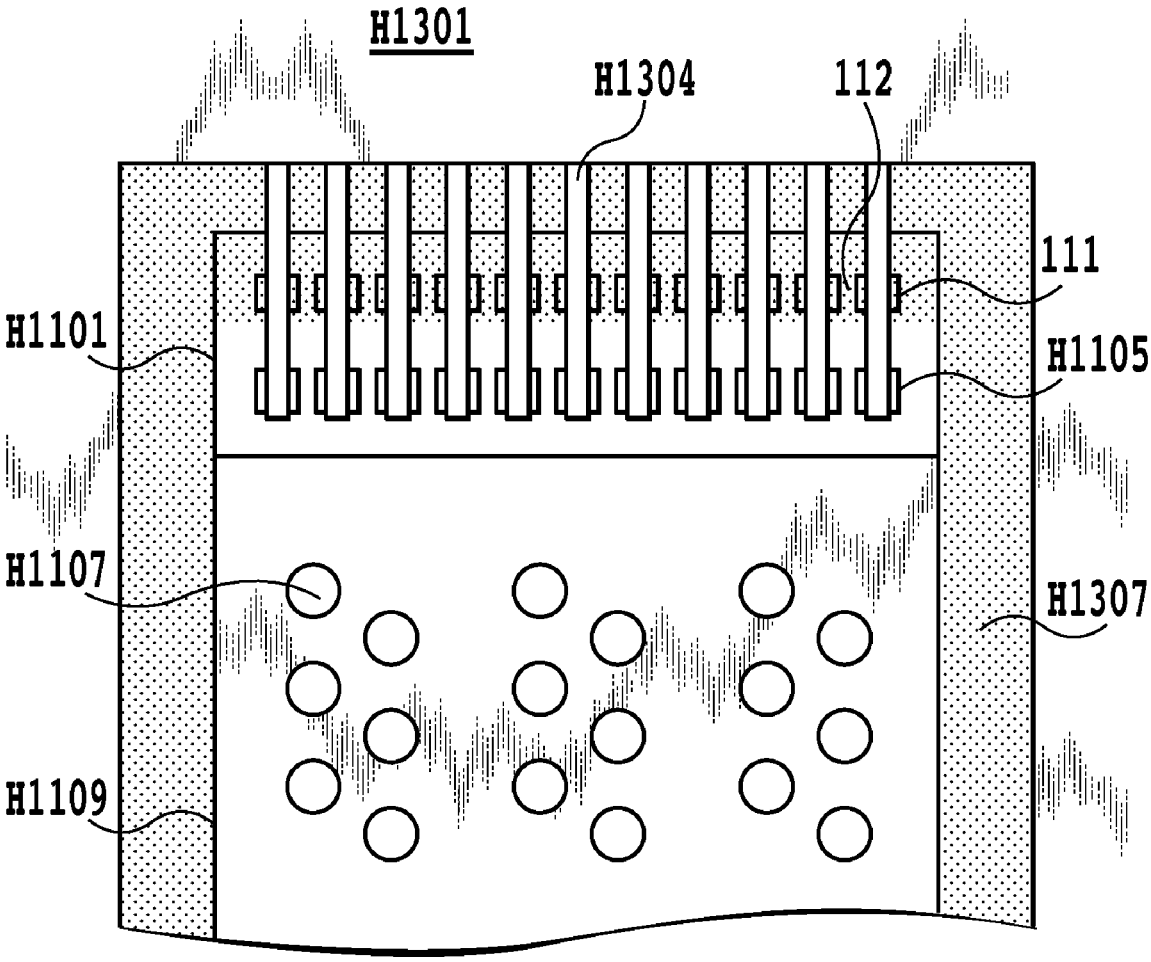
FIG. 9 is an explanatory diagram explaining a state where the first sealant applied to the construction of the first embodiment spreads out.
Figure 10:
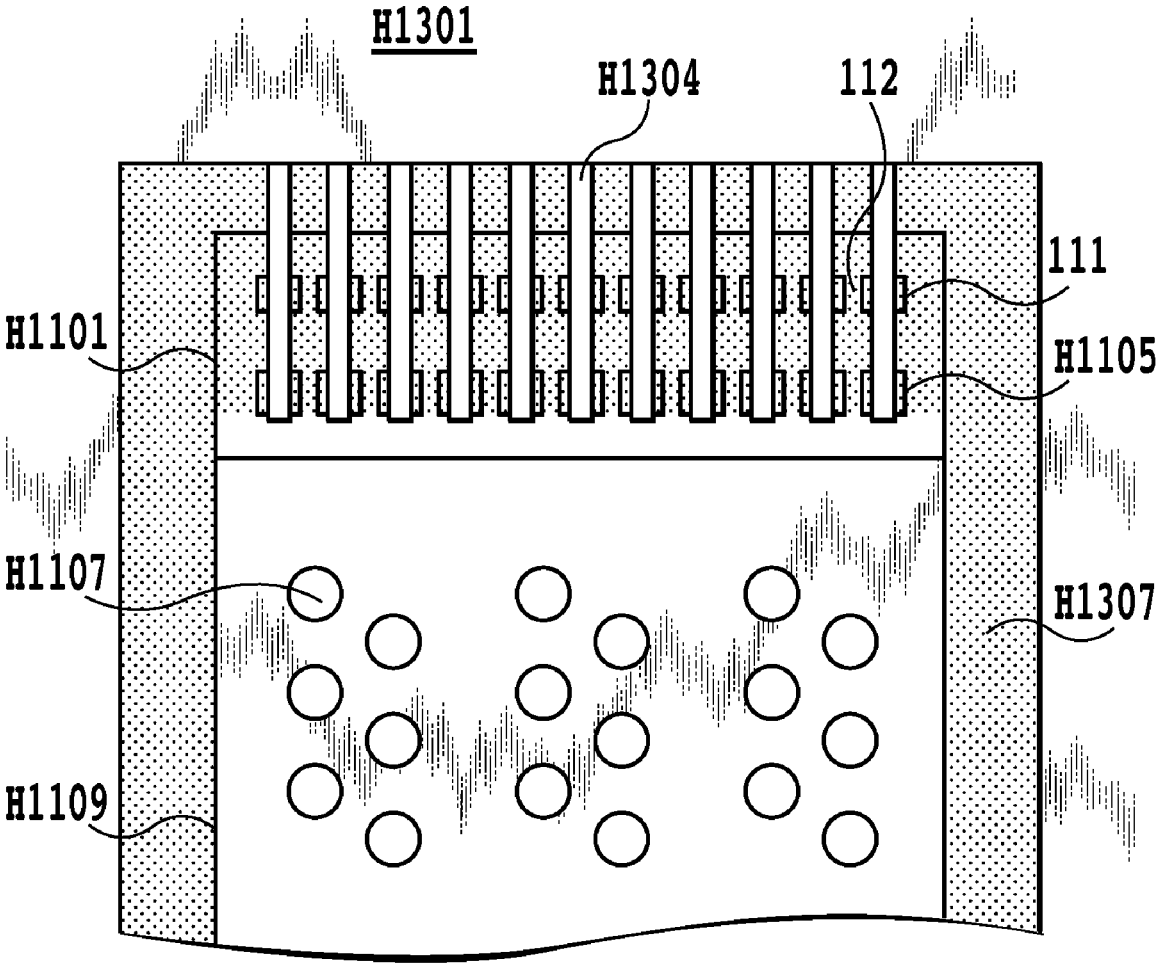
FIG. 10 is an explanatory diagram explaining a state where the first sealant applied to the construction of the first embodiment spreads out.

FIG. 8 to FIG. 10 are explanatory diagrams each explaining a state where the first sealant H1307 applied to the above construction spreads out.

Figure 16:
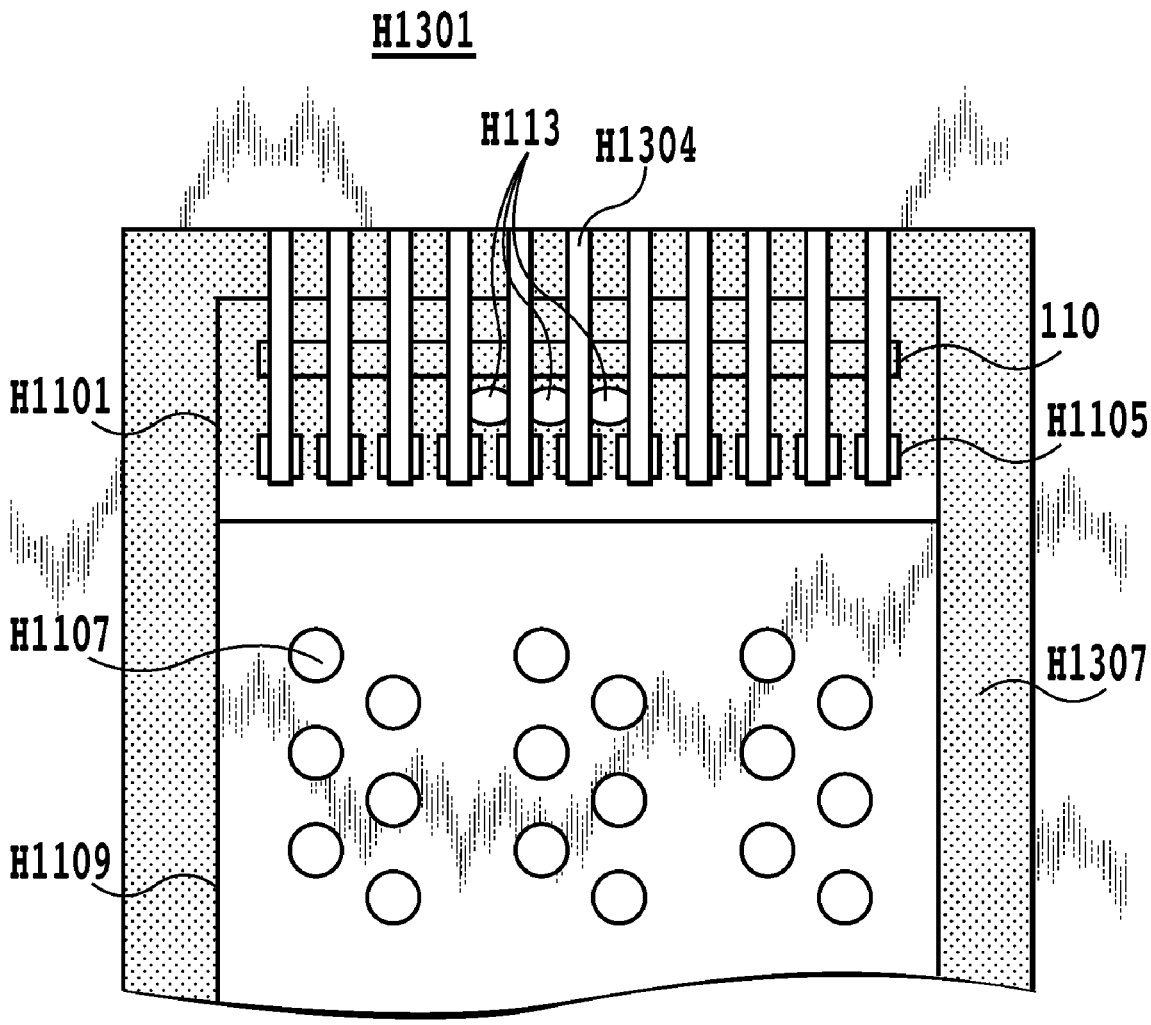
FIG. 16 is a diagram for explaining a problem which occurs when applying a first sealant to the conventional print element substrate.

First, the first sealant H1307 is applied to a clearance between the print element substrate H1101 and the recess of the flow path member H1200 in which the print element substrate H1101 is located, that is, a periphery of the print element substrate H1101, by using a dispense method. Then, after the first sealant H1307 gradually spreads along the peripheral side surfaces of the print element substrate H1101, it spreads out to the vicinity of the connecting portion between the front end of the lead terminal H1304 and the electrode terminal H1105 due to a capillary force between the lead terminals H1304. FIG. 8, as shown in arrows, shows a state where element substrate H1101. FIG. 9 shows a state where the first sealant H1307 is spreading from the edge of the print element substrate H1101 toward the electrode terminal H1105 on the print element substrate H1101 due to the capillary force between the lead terminals H1304. Here, the first sealant H1307 can pass through the groove 112 existing between the convex portions 111. Therefore, air bubbles or regions 113 (refer to FIG. 16) where the first sealant H1307 is not filled are difficult to remain between the lead terminal H1304 and the print element substrate H1101 or between the lead terminals H1304. FIG. 10 shows a state where the first sealant H1307 spreads out to the connecting portion between the front end of the lead terminal H1304 and the electrode terminal H1105 and the sealing is substantially completed.

As described above, the insulating portion 110 according to the present embodiment is not a member integrally extending along the edge of the print element substrate H1101, but has the convex portions 111 separated from each other each corresponding to the lead terminal H1304 and the electrode terminal H1105, wherein the groove 112 is formed between the convex portions 111. Accordingly, the first sealant H1307 which will spread toward the vicinity of the connecting portion between the front end of the lead terminal H1304 and the electrode terminal H1105 is not blocked by the insulating portion 110. That is, the first sealant H1307 goes along the grooves 112 and reaches to the connecting portion between the end of the lead terminal H1304 and the electrode terminal H1105, thereby enabling the first sealant H1307 to be sufficiently filled in this portion. Therefore, air bubbles or the region 113 where the first sealant H1307 is not filled are difficult to remain between the lead terminal H1304 and the print element substrate H1101 or between the lead terminals H1304.

Therefore, there does not occur the defect that in the heating process for sealant hardening as the process after the second sealant 1308 is applied, the air inflates or bursts in the region 113 to burst through the second sealant H1308 applied on the first sealant H1307. As a result, since the electrical connecting portion is not exposed, the possibility that the ink causes the electrical short, which deteriorates reliability of the print head can be reduced. Further, since there does not exist the region 113 of making the structure of the print head weak, there can be also prevented occurrence of the problem that a crack is produced in the sealant by an external force applied at print operation after mounting the print head to the printing apparatus, breaking the insulated condition.

In addition, in a case of adopting the conventional construction, the margin to conditions such as an applying position or an application speed in the application process of the sealant is made small from a viewpoint of forcing the above region 113 not to remain. In contrast, according to the present embodiment, these conditions are easily set, enabling productivity of the print head to largely improve.

Further, since a defective fraction of the print head in the production process due to occurrence of the above region 113 is made remarkably small, the productivity of the print head can be furthermore improved.

(3) Second Embodiment

Figure 11:
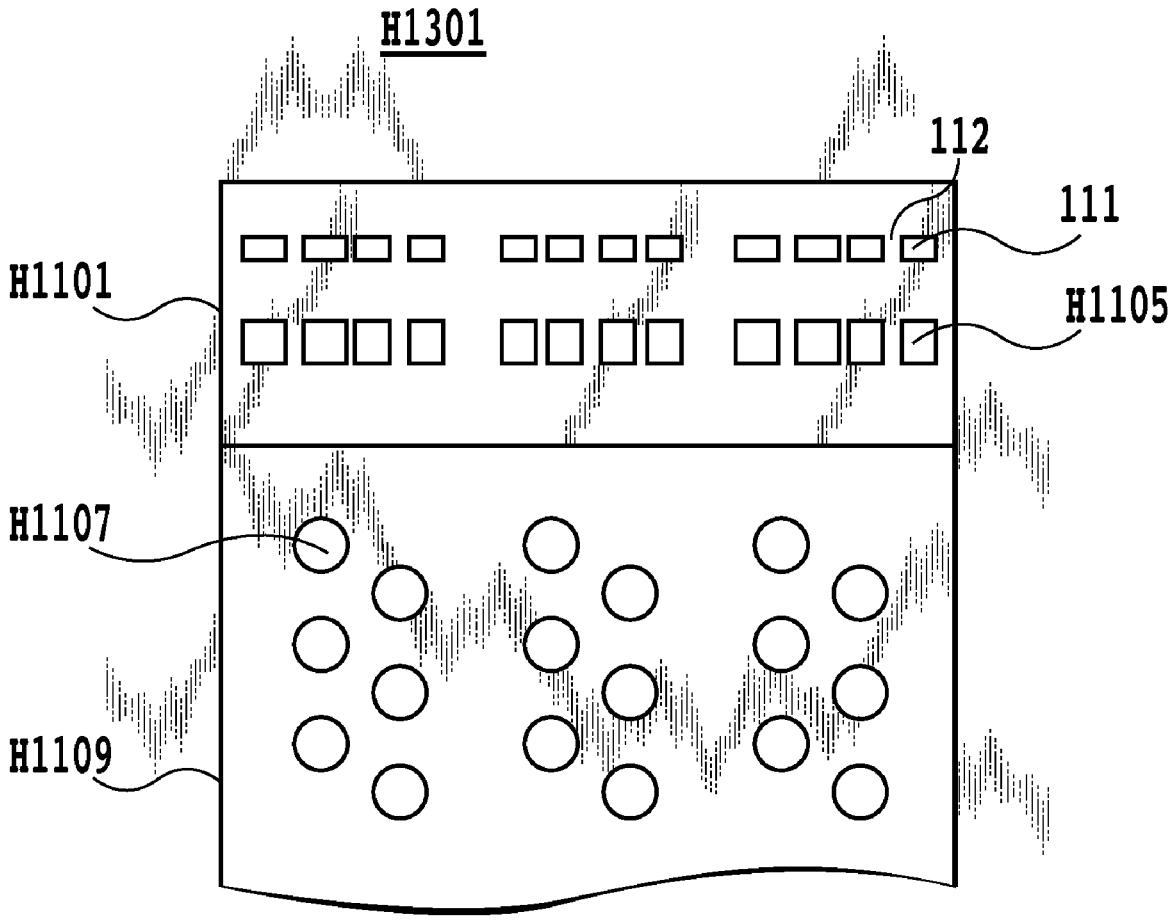
FIG. 11 is a schematic plan view of a print element substrate according to a second embodiment of the present invention.
Figure 12:
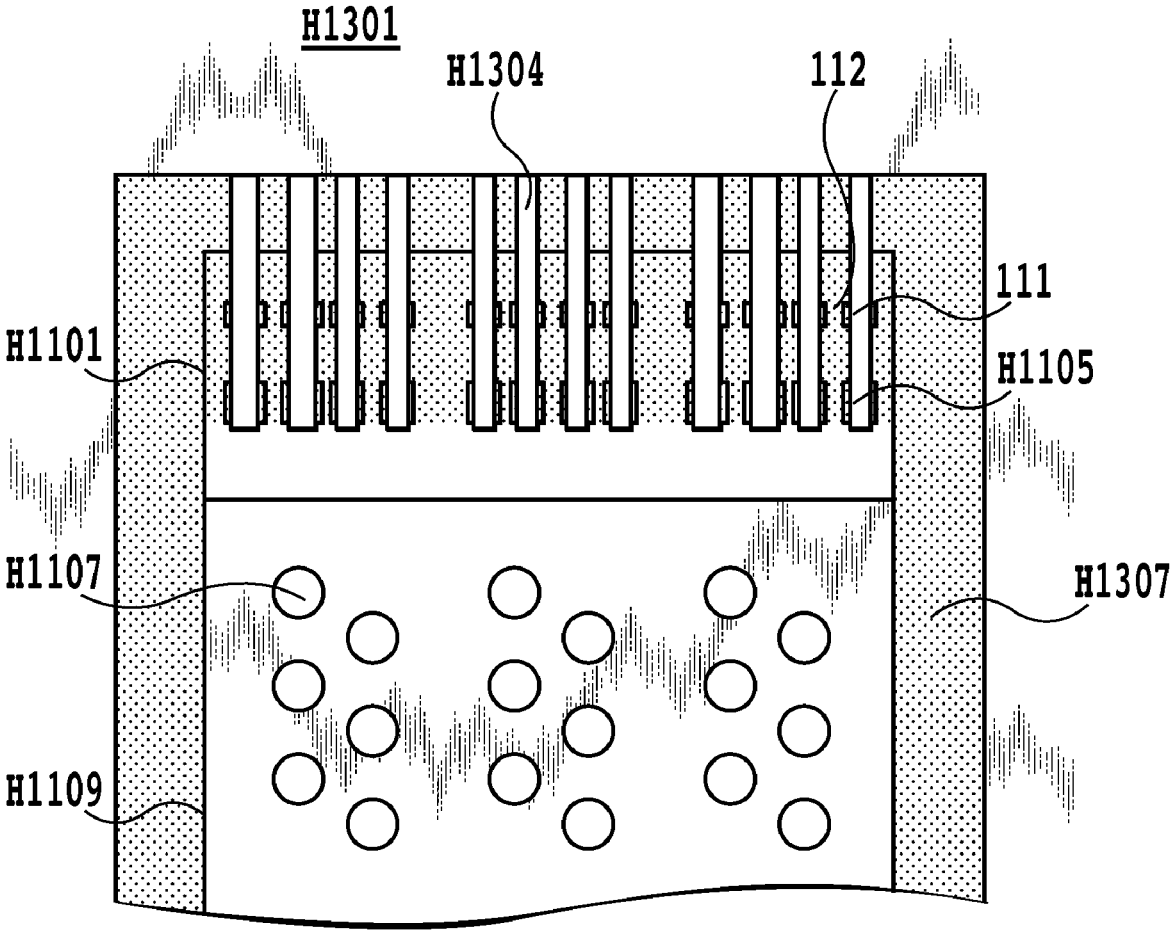
FIG. 12 is a schematic plan view showing a connecting portion between the print element substrate shown in FIG. 11 and an electrical wiring tape.
Figure 13:
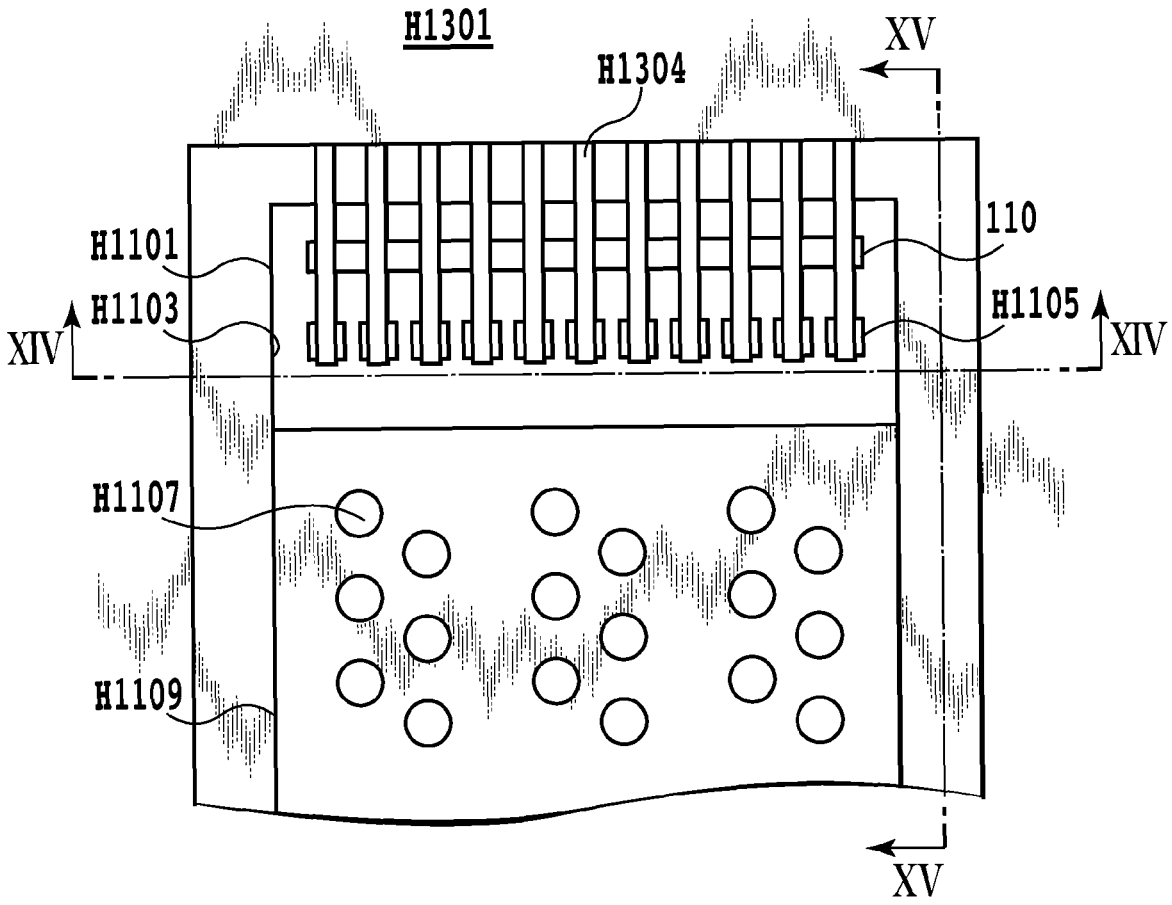
FIG. 13 is a schematic plan view showing a connecting portion between a conventional print element substrate and an electrical wiring tape.
Figure 14:
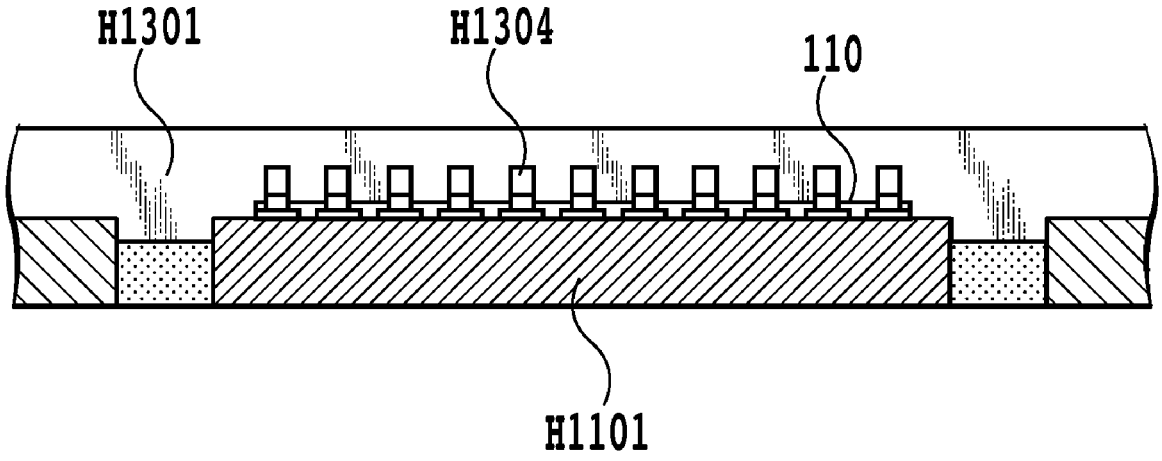
FIG. 14 is a schematic cross section taken along line XIV-XIV in FIG. 13.
Figure 15:
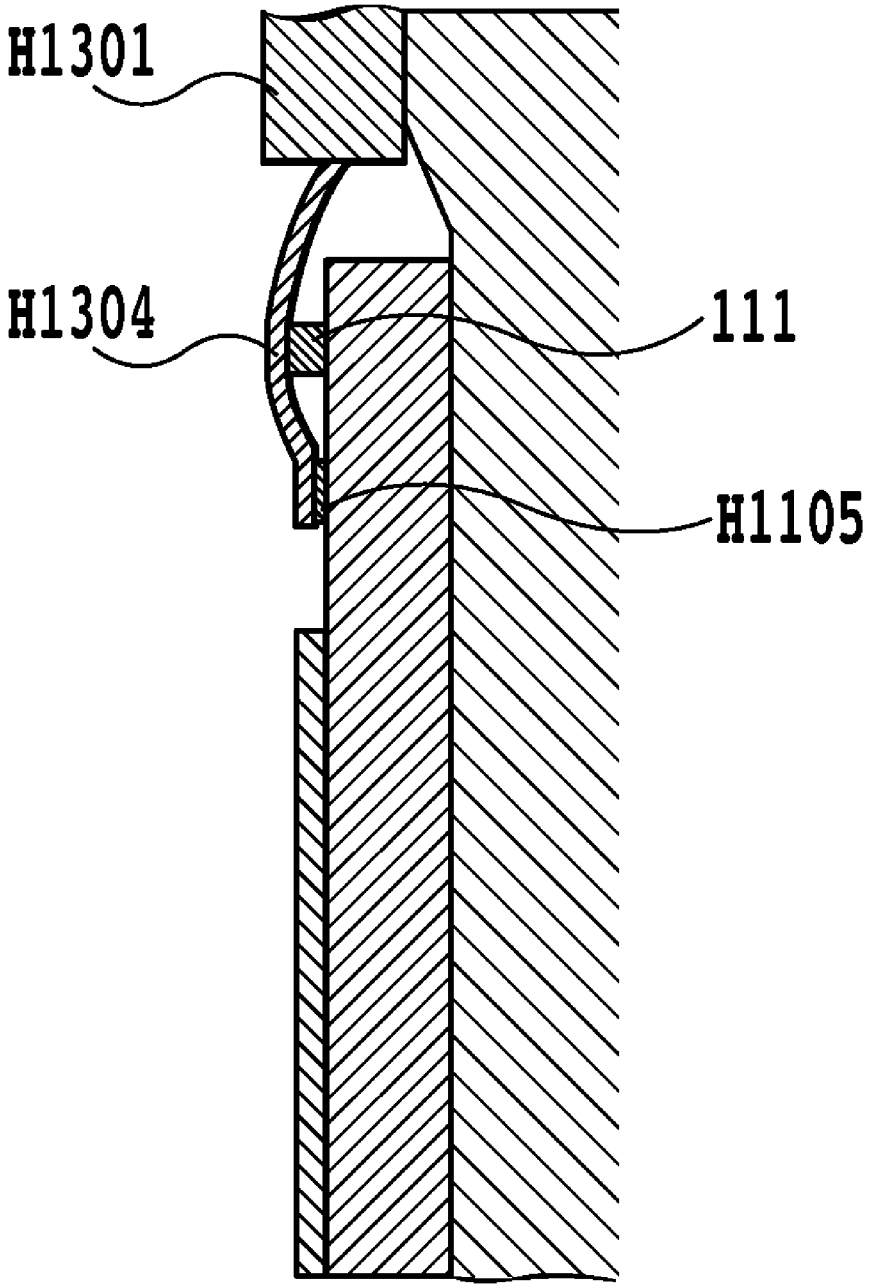
FIG. 15 is a schematic cross section taken along line XV-XV in FIG. 13.

By referring to FIGS. 11 and 12, the characteristic construction of the second embodiment in the present invention will be explained in detail. FIG. 11 is a schematic plan view of a print element substrate according to the second embodiment. FIG. 12 is a schematic plan view showing the connecting portion between the print element substrate and an electrical wiring tape. Components identical to those in the first embodiment are referred to as identical reference symbols.

In the first embodiment, the construction where the electrode terminals H1105 of the print element substrate H1101 each having an equal width and the lead terminals H1304 of the electrical wiring tape H1301 each having an equal width are arranged as having an equal clearance has been described. However, the present invention can be applied as shown in FIG. 11 and FIG. 12 even in a case where each width and each clearance of each of the electrode terminals H1105 and the lead terminals H1304 are not uniform. That is, the convex portion 111 or the groove 112 can be provided to match the width of each of the electrode terminals H1105 and each of the lead terminals H1304 and each clearance thereof. It should be noted that dimensions of the other respective portions, for example the length from the convex portion 111 to the edge of the print element substrate H1101 in the lead-terminal extending direction or the thickness of the convex portion 111 can be made substantially the same as in the first embodiment.

Also in the present embodiment, first, the first sealant H1307 is applied to the clearance between the print element substrate H1101 and the recess of the flow path member H1200 in which the print element substrate H1101 is located, that is, a periphery of the print element substrate H1101. Then, after the first sealant H1307 gradually spreads along the peripheral side surface of the print element substrate H1101, it spreads out to the vicinity of the connecting portion between the front end of the lead terminal H1304 and the electrode terminal H1105 due to a capillary force between the lead terminals H1304. Here, since the first sealant H1307 can pass through the groove 112 provided between the convex portions 111, the above region 113 (refer to FIG. 16) is difficult to remain. Therefore, the effect similar to that of the above-mentioned first embodiment can be obtained.

(4) Others

In each of the embodiments, the convex portion for insulation is provided in each of the plurality of the connecting terminals (the lead terminals) of the electrical wiring tape. That is, the groove is provided in each position provided between all the neighboring lead terminals. Here, the groove functions in such a manner that the spread of the first sealant toward the connecting portion between the front end of the lead terminal and the electrode terminal of the print element substrate is made smooth and thereby, the non-existence region of the sealant due to the blocking of the first sealant is not left. Therefore, as long as this function is not interrupted, the groove may be provided between at least a part of lead terminals. That is, some lead terminals continuously arranged may be insulated by one convex portion.

In the above embodiments, the present invention is applied to the construction of the print element substrate H1101 for ejecting inks of three colors of cyan, magenta and yellow and the print head H1001 using this. However, the kind and the number of the color tones (color and density) of ink used in the print element substrate or the print head can be determined as appropriate.

Further, the above embodiments, the present invention is applied to the print head integral with the ink containing portion to be inseparable with each other. However, a main object of the present invention is to prevent occurrence of the region where air bubbles remain or where the first sealant is not filled for securing the insulated condition, thus improving reliability of the print element substrate or finally the print head. Therefore, according to this view, the present invention can be effectively applied to the form of the print head integral with an ink tank to be separable therefrom or also to the form of the print head provided independently from the ink tank.

Further, in the above embodiments, the construction has been described that uses the print element substrate in the form where a main plane thereof is provided in a direction substantially perpendicular to the ejection direction of ink and the electrothermal transducer elements are located on the main plane. However, the present invention can be applied to the print element substrate in the form where a main plane thereof is provided in a direction substantially in parallel to the ejection direction of ink and the electrothermal transducer elements are located on the main plane.

Further, in regard to the ink ejection system, in addition to the system using the above electrothermal transducer element, that is, the system generating thermal energy as energy used for ejecting ink, a system generating mechanical energy by piezo elements or the like may be also adopted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-322397, filed Dec. 18, 2008, which is hereby incorporated by reference herein in its entirety.

What is claimed is:

1. A method of manufacturing an inkjet print head comprising the steps of:

preparing a print element substrate having a plane provided with elements generating energy for ejecting ink, a plurality of electrode terminals connected electrically to the elements and arranged in an array, and a plurality of insulating members arranged in an array along the plurality of the electrode terminals, the plurality of insulating members being provided on a portion more closer to an edge of the plane than the plurality of electrode terminals;

locating a plurality of electrical wiring members electrically connecting an external electrical wiring substrate to the electrode terminals in such a manner as to be in contact with the electrode terminals, and to be supported by the plurality of insulating members; and applying a sealing member on a periphery of the print element substrate in such a manner that the sealing member reaches between the neighboring electrical wiring members and providing the sealing member between the neighboring electrode terminals using a capillary force between the neighboring electrical wiring members.

2. A method of manufacturing an inkjet print head as claimed in claim 1, further comprising:

a step of providing another sealing member topside the electrode terminals and the electrode wiring members to seal them.

3. A method of manufacturing an inkjet print head as claimed in claim 1, wherein the insulating members are provided to correspond respectively to the electrode terminals.

4. An inkjet print head comprising:

a print element substrate having a plane provided with elements generating energy for ejecting ink, a plurality of electrode terminals connected electrically to the elements and arranged in an array, and a plurality of insulating members arranged in an array along the plurality of the electrode terminals, the plurality of insulating members being provided on a portion more closer to an edge of the plane than the plurality of electrode terminals;

a plurality of electrical wiring members in contact with the electrode terminals to electrically connect an external electrical wiring substrate to the electrode terminals, and supported by the plurality of insulating members; and a sealing member provided between the neighboring electrical wiring members, wherein the insulating members are provided to correspond respectively to the electrode terminals.

5. An inkjet print head as claimed in claim 4, wherein the insulating members are provided between the electrical wiring members and the plane in a direction perpendicular to the plane to support the electrode terminals.

6. An inkjet print head as claimed in claim 4, wherein the sealing member is provided also between the neighboring insulating members.

7. An inkjet print head as claimed in claim 4, wherein a width between the neighboring insulating members is smaller than a width between the neighboring electrode terminals.

8. An inkjet print head as claimed in claim 4, wherein the sealing member is filled between the neighboring electrode terminals by flowing in a direction from the insulating members toward the electrode terminals due to a capillary force between the neighboring electrical wiring members.

9. An inkjet print head as claimed in claim 4, wherein another sealing member is provided topside the electrode terminals and the electrode wiring members to seal them.

* * * * *